US006935007B2

(12) United States Patent
Cortigiano, Sr.

(10) Patent No.: US 6,935,007 B2
(45) Date of Patent: Aug. 30, 2005

(54) METHOD AND APPARATUS FOR GRIPPING ZIPPER TAPE DURING SLIDER INSERTION

(75) Inventor: Ronald Cortigiano, Sr., Toccoa, GA (US)

(73) Assignee: Illinois Tool Works Inc., Glenview, IL (US)

( * ) Notice: Subject to any disclaimer, the term of this patent is extended or adjusted under 35 U.S.C. 154(b) by 74 days.

(21) Appl. No.: 10/208,612

(22) Filed: Jul. 31, 2002

(65) Prior Publication Data

US 2004/0020034 A1 Feb. 5, 2004

(51) Int. Cl.[7] ..... B21D 53/52; A41H 37/06

(52) U.S. Cl. ..... 29/410; 29/33.2; 29/408; 29/409; 29/768

(58) Field of Search ..... 29/33.2, 408, 409, 29/410, 766, 768

(56) References Cited

U.S. PATENT DOCUMENTS

| | | | | | |
|---|---|---|---|---|---|
| 3,426,396 | A | | 2/1969 | Laguerre | 24/201 |
| 3,701,191 | A | | 10/1972 | Laguerre | 29/207.5 |
| 3,701,192 | A | | 10/1972 | Laguerre | 29/207.5 |
| 4,581,006 | A | * | 4/1986 | Hugues et al. | 493/213 |
| 4,980,968 | A | * | 1/1991 | Hilterhaus et al. | 29/768 |
| 6,131,369 | A | | 10/2000 | Ausnit | 53/412 |
| 6,161,271 | A | * | 12/2000 | Schreiter | 29/408 |
| 6,199,256 | B1 | * | 3/2001 | Revnew et al. | 29/408 |
| 6,418,605 | B1 | * | 7/2002 | Kettner | 29/408 |
| 6,442,819 | B1 | * | 9/2002 | Kettner | 29/408 |
| 6,460,238 | B1 | * | 10/2002 | LaRue et al. | 29/408 |
| 6,526,726 | B1 | * | 3/2003 | Strand et al. | 53/412 |
| 6,584,666 | B1 | * | 7/2003 | Savicki | 29/408 |
| 6,675,558 | B2 | * | 1/2004 | Kinigakis et al. | 53/412 |
| 6,796,015 | B2 | * | 9/2004 | Cortigiano, Sr. | 29/410 |
| 6,836,945 | B2 | * | 1/2005 | Savicki | 29/408 |
| 6,842,973 | B2 | * | 1/2005 | Share et al. | 29/768 |
| 2003/0183314 | A1 | * | 10/2003 | Share et al. | 156/66 |

* cited by examiner

*Primary Examiner*—Essama Omgba
(74) *Attorney, Agent, or Firm*—Ostrager Chong Flaherty & Broitman PC

(57) ABSTRACT

A zipper guide apparatus having different operational states. In the first operational state, the zipper tape is held securely, i.e., gripped, in a zone adjacent the slider insertion zone during slider insertion. In a second operational state, the zipper tape is not held securely in the zone adjacent the slider insertion zone and a slider can pass through the zipper guide during zipper tape advancement. These operational states are under the control of a programmable controller or other control device, which synchronizes zipper guide operation with operation of the slider inserter. The zipper guide comprises a saddle on which a zipper is seated and a pair of opposing grippers that extend to grip the zipper tape and that retract to release the zipper tape and allow passage of the zipper tape with sliders inserted thereon.

27 Claims, 10 Drawing Sheets

METHOD AND APPARATUS FOR GRIPPING ZIPPER TAPE DURING SLIDER INSERTION

BACKGROUND OF THE INVENTION

This invention generally relates to slider-operated plastic zippers intended for use in reclosable pouches, bags or other packages. In particular, the invention relates to methods and apparatus for supporting zipper tape during slider insertion.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled structures, portions of which form a fulcrum about which the profiled structures may be pivoted out of engagement when lower edges of the bases are forced towards each other.

An improvement in sliders is disclosed in U.S. patent application Ser. No. 10/096,409 filed on Mar. 11, 2002 and entitled "Insertion Apparatus for Attaching Sliders onto Zipper Bags and Film". This slider can be inserted on the zipper in a manner such that the zipper will be secured in the slider. As a result, during an opening of the reclosable bag the interlocking closure elements of the zipper will not unintentionally re-engage within the slider. For example, a re-engagement of the interlocking closure elements could occur when the zipper opening end of the slider is pushed toward a closed zipper park position. Such a re-engagement can occur during operation of the zipper or if the slider is inserted too far from a slider end stop on the zipper. By reducing the possibility of unintentional re-engagement of the interlocking members of the profiles, production of defective bags is reduced.

U.S. patent application Ser. No. 10/096,409 discloses a slider insertion apparatus comprising an activator that opens a first portion of a zipper tape, a pusher that inserts the slider onto a second portion of the zipper tape, and a zipper guide that holds a third portion of the zipper tape closed. The zipper guide and the activator with pusher are manufactured to facilitate forward movement of the zipper tape within the slider insertion apparatus; to properly position the profiles of a section of zipper for slider insertion; and to secure an adjacent section of the zipper when the slider is inserted. A loading rack with a supply of sliders may be part of the slider insertion apparatus, with the loading rack being a mechanically attachable device or module.

In the slider insertion process, a closed zipper tape is guided by a pair of opposing grooves formed in opposing parts of a zipper guide to an insertion point under the activator with pusher. An activating fork of the activator with pusher offsets the interlocking members in a section adjacent to where the slider is inserted. The slider is inserted onto the interlocked zipper tape by the pusher. The interlocked zipper tape is supported in the area where the slider is inserted by a pair of guide blades.

The above-described grooves in the zipper guide form a passageway for translation of a zipper tape along its longitudinal axis. Because the grooves are configured and arranged to define a cross-sectional passage that generally conforms to the profile of the closed zipper tape, e.g., an A-shaped profile, the zipper tape has only one degree of freedom, namely longitudinal translation. A zipper guide with a narrow passageway for the zipper profile only will not allow passage of a slider inserted on the zipper tape. Therefore such a zipper guide cannot be used in cases where zipper activation occurs behind the inserted slider and the zipper guide holds the zipper tape in front of the slider insertion area. Also, a static zipper guide (having an unchanging guideway for the zipper tape) cannot be used in cases where dual sliders are inserted on respective zipper lengths by respective slider insertion devices and then the zipper tape is advanced or indexed two zipper lengths, each zipper length having a slider inserted thereon. In order to advance the zipper tape in these cases, the size of the passageway of the zipper guide must be increased to allow passage of a slider through the zipper guide station.

Thus there is a need for a zipper guide apparatus having different states, wherein the zipper tape is held securely in a zone adjacent the slider insertion zone during slider insertion in a first state and is not held securely in the adjacent zone and allows a slider to pass through during zipper tape advancement.

BRIEF DESCRIPTION OF THE INVENTION

The present invention is directed to a zipper guide apparatus having different operational states. In the first operational state, the zipper tape is held securely, i.e., gripped, in a zone adjacent the slider insertion zone during slider insertion. In a second operational state, the zipper tape is not held securely in the zone adjacent the slider insertion zone and a slider can pass through the zipper guide during zipper tape advancement. These operational states are under the control of a programmable controller or other control device, which synchronizes zipper guide operation with operation of the slider inserter.

One aspect of the invention is an apparatus for inserting sliders on a zipper tape, comprising: a pusher movable from a retracted position to an extended position for inserting a slider onto a section of the zipper tape; a saddle having a straight edge that is positioned to contact the section of zipper tape during insertion of a slider thereon; and a pair of grippers disposed on opposite sides of the zipper tape. Each gripper is movable between respective extended and retracted positions to grip the zipper tape when the grippers are in the extended positions and to not grip the zipper tape when the grippers are not in the extended positions.

Another aspect of the invention is an apparatus for holding a zipper tape of the type comprising first and second profiled interlockable closure members and first and second extensions flanges respectively connected to the first and second closure elements and extending generally in the same direction, the first and second interlockable closure members being interlocked. The apparatus comprises: a saddle having a straight edge that is inserted between the first and second zipper flanges for supporting a section of the zipper tape; and a pair of grippers disposed on opposite sides of the zipper tape. Each gripper is movable between respective extended and retracted positions to press the first and second closure members together when the grippers are in the extended positions and to not press the first and second closure members together when the grippers are not in the extended positions. Each gripper comprises a respective angled block.

A further aspect of the invention is a slider insertion machine comprising: an assembly for inserting sliders onto a first section of zipper tape; a pair of grippers disposed on opposite sides of a second section of the zipper tape; and a saddle having a straight edge that is positioned to contact the first and second sections of the zipper tape during insertion of a slider thereon. Each gripper is movable between respective extended and retracted positions to grip the second section when the grippers are in the extended positions and to not grip the second section when the grippers are not in the extended positions.

Yet another aspect of the invention is a method of inserting a slider onto a zipper tape, comprising the following steps: seating a zipper tape on a saddle with zipper flanges of the zipper tape flanking the saddle; advancing the zipper tape to a longitudinal position whereat a first section of the zipper tape is in a slider insertion zone; extending a pair of grippers to press against a second section of the zipper tape from opposite sides; and inserting a slider onto the first section of the zipper tape while the second section of the zipper tape is being gripped.

A further aspect of the invention is a method of inserting sliders onto a zipper tape, comprising the following steps: seating a zipper tape on first and second saddles with zipper flanges of the zipper tape flanking the saddles, the first and second saddles being in line and spaced apart; advancing the zipper tape to a longitudinal position whereat a first section of the zipper tape is in a first slider insertion zone overlying a portion of the first saddle and a second section of the zipper tape is in a second slider insertion zone overlying a portion of the second saddle; concurrently extending a first pair of grippers to press against a third section of the zipper tape from opposite sides and a second pair of grippers to press against a fourth section of the zipper tape from opposite sides; and concurrently inserting a first slider onto the first section and a second slider onto the second section of the zipper tape while the third and fourth sections of the zipper tape are being gripped.

Yet another aspect of the invention is an apparatus comprising: a rigid base; a pusher; first means for displacing the pusher along a first axis, the first displacing means being mounted to the base; a support structure supported by the base; a plate attached to the support structure and extending from the support structure toward the pusher, the plate lying in a plane generally parallel with the first axis; first and second gripper elements; second means for displacing the first gripper element along a second axis generally transverse to the first axis, the second displacing means being mounted to the support structure; and third means for displacing the second gripper element along a third axis generally transverse to the first axis, the third displacing means being mounted to the support structure.

Other aspects of the invention are disclosed and claimed below.

DETAILED DESCRIPTION OF THE INVENTION

Figure 1:
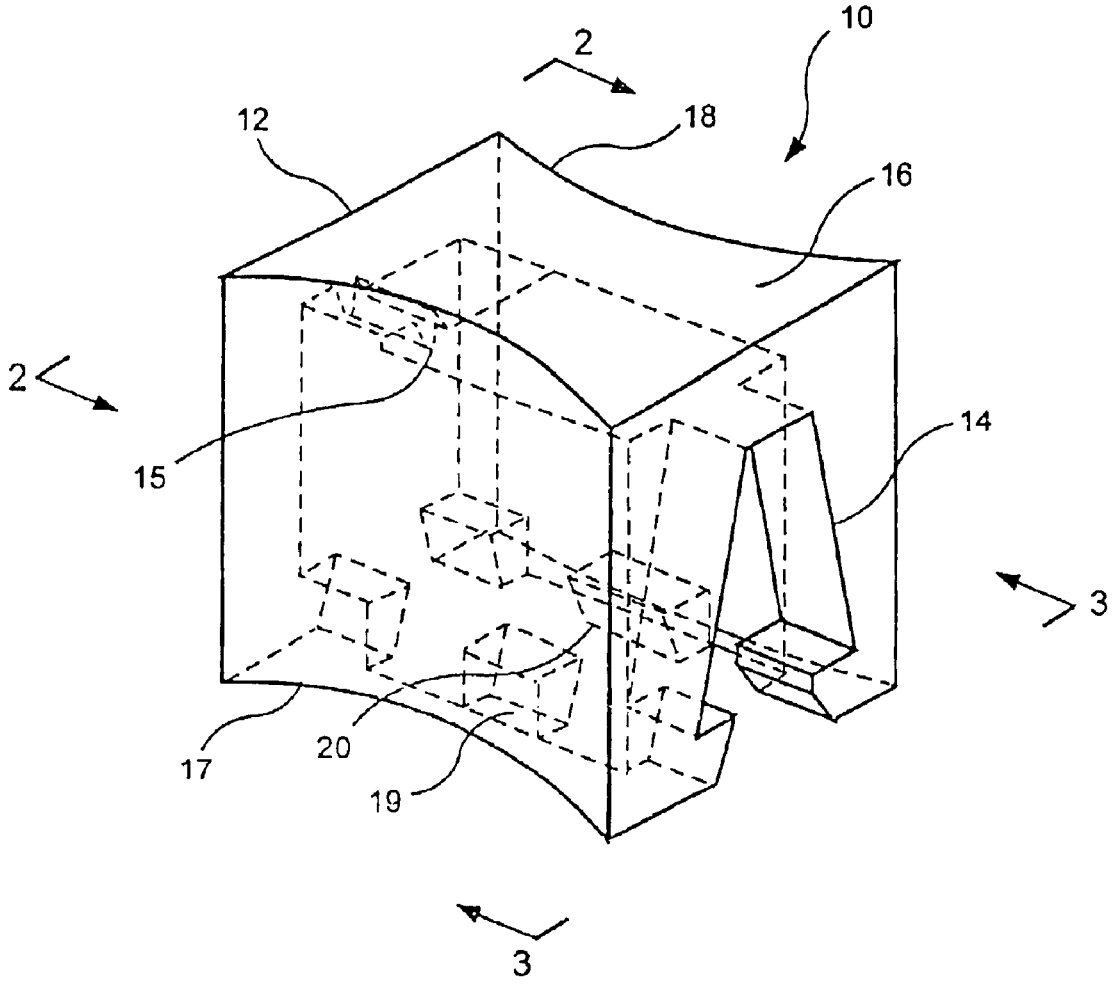
FIG. 1 is a drawing showing an isometric view of one type of slider that can be inserted on a zipper using the slider insertion apparatus disclosed herein.

Reference will now be made to the drawings, in which similar elements in different drawings bear the same reference numerals. For the purpose of illustration, the present invention will be described with reference to insertion of a slider of the type depicted in FIG. 1. However, application of the retractable zipper guide of the present invention is not limited to sliders of the type described below.

The slider 10 shown in FIG. 1 comprises a top wall 16 and opposing side walls or arms 17 and 18 integrally with opposite sides of the top wall 16, forming a channel having a zipper opening end 12 and a zipper closing end 14. The slider comprises a keeper 15 extending downward from the top wall 16 and disposed between arms 17 and 18. The slider further comprises a plurality of mutually aligned, longitudinally extending retaining shoulders 19 projecting from the side wall 17, and a plurality of mutually aligned, longitudinally extending retaining shoulders 20 projecting from the side wall 18. The retaining shoulders 19 and 20 are shown as separate; however, the shoulders may be continuous along the length of the slider 10.

Figure 2:
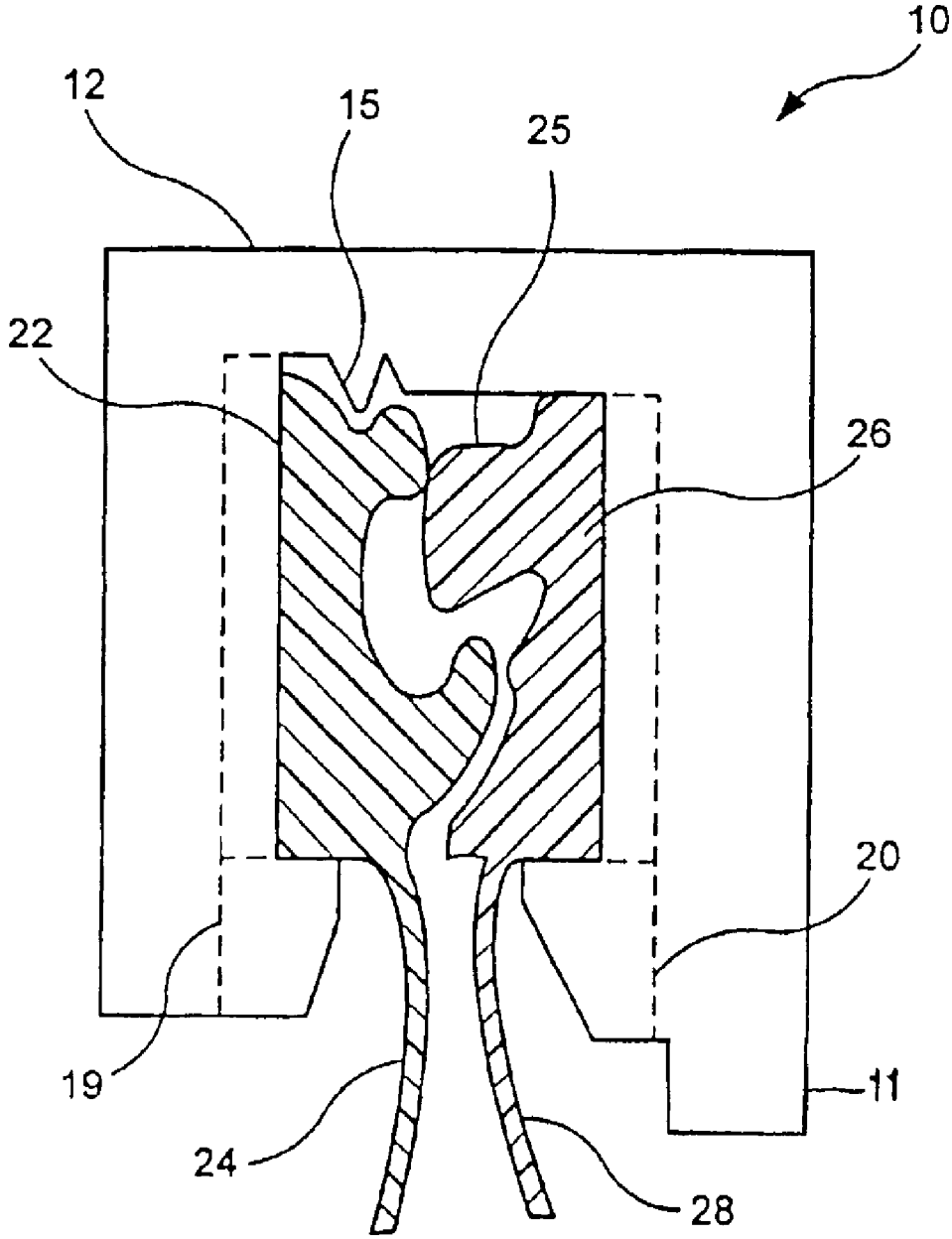
FIGS. 2 and 3 are drawings showing respective end views of the zipper opening end and zipper closing end of the slider depicted in FIG. 1, with the slider shown encompassing a portion of a zipper.

The keeper 15, as well as the retaining shoulders 19 and 20, secure a zipper within the slider 10, as shown in FIG. 2. FIG. 2 is an end view of the zipper opening end of the slider 10 with the slider shown encompassing a portion of a zipper 25 of a type known to those skilled in the art. In the state depicted in FIG. 2, the keeper 15 secures an interlocking member 22 of zipper part or half 24 of zipper 25 by preventing the interlocking member 22 from moving toward the mating interlocking member 26 of zipper part or half 28. If the interlocking members are formed of a sufficiently stiff material, the interlocking member 22 may include a slight recess to accommodate the keeper 15. By preventing movement of the interlocking member 22 towards the interlocking member 26, the zipper parts 24 and 28 always remain partially disengaged at the opening end, thereby reducing the possibility of an unintentional full engagement of the interlocking members within the slider.

Figure 3:
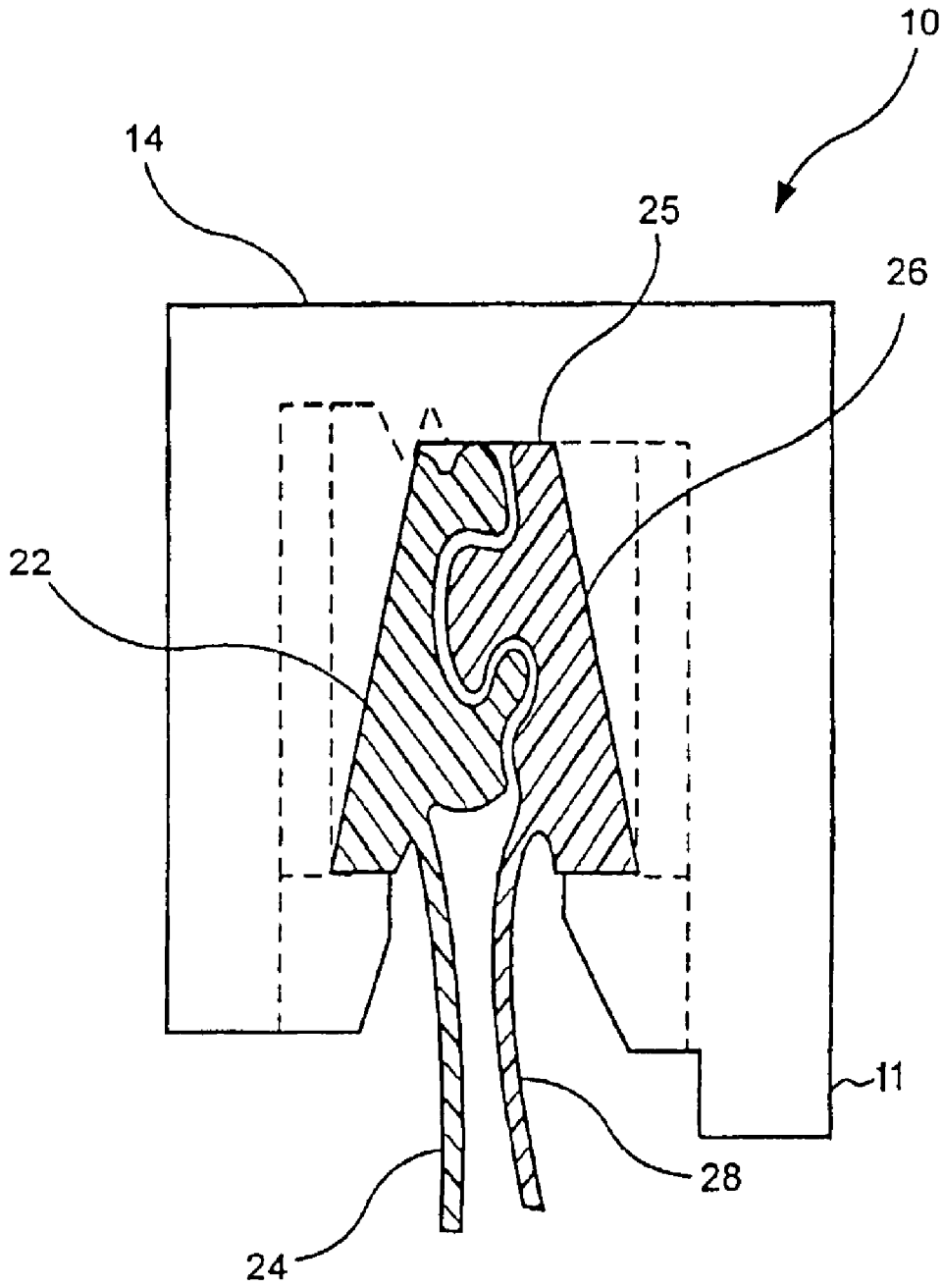

The arms of the slider are designed with interior surfaces having lower portions that converge in a direction from the opening end of the slider to the closing end, and having upper portions that diverge in the same direction. The lower portions on the interior surfaces of the slider arms 17 and 18 press the bottom edges of the interlockable members 22 and 26 toward each other when the slider is moved in the closing direction. These members are designed with surfaces that cooperate to form a fulcrum, about which the interlockable members rotate when their bottom edges are pressed together, causing the zipper portions above the fulcrum point to separate. In particular, the male and female profiles disengage, thereby opening the zipper as seen in FIG. 2. Conversely, when the slider is moved in the opposite or opening direction, the upper portions of the interior surfaces of the slider arms press the upper portions of the interlockable members 22 and 26 together, causing the zipper to close, as seen in FIG. 3.

Figure 4:
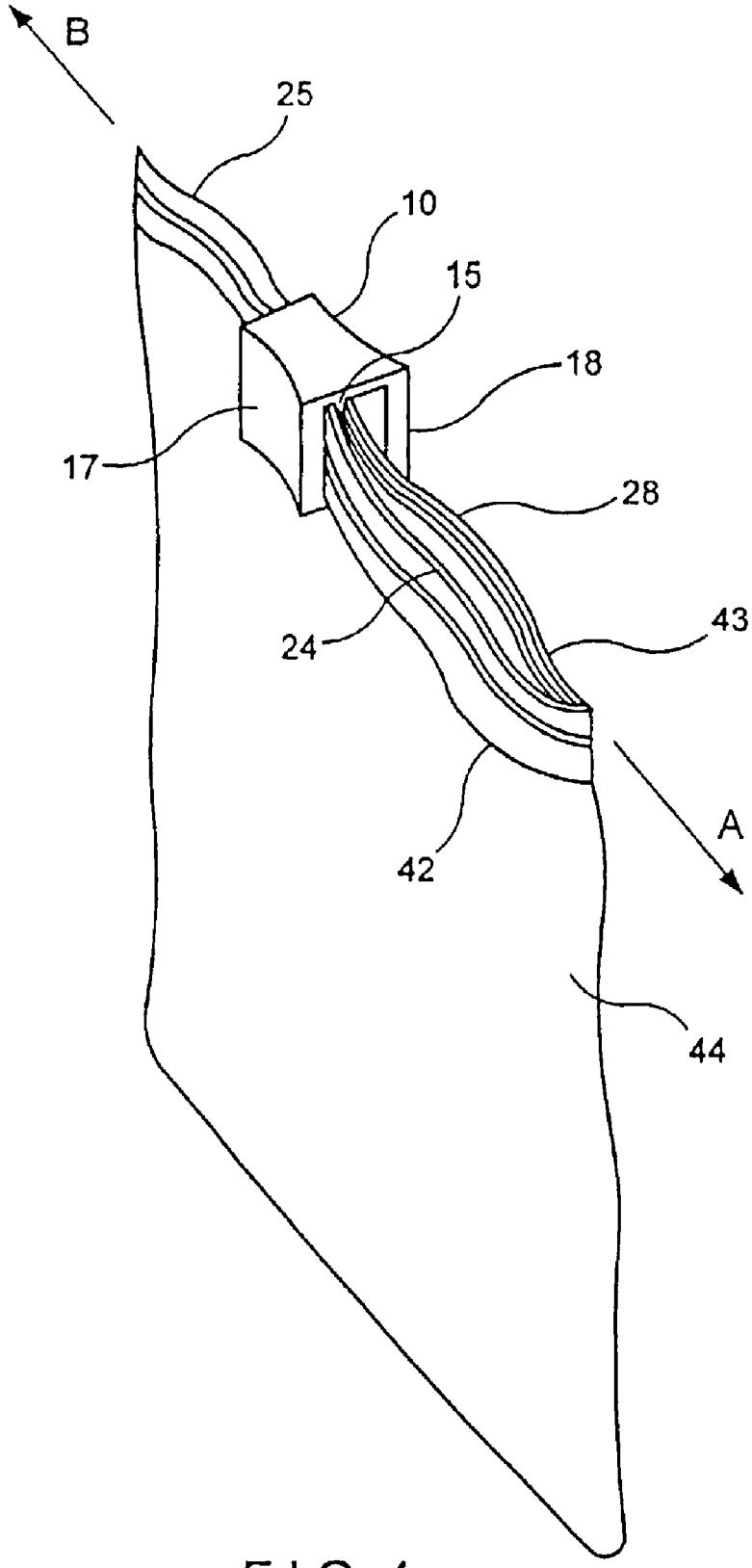
FIG. 4 is a drawing showing an isometric view of a reclosable plastic bag having a zipper operated by the slider shown in FIGS. 1–3.

FIG. 4 is an isometric view of a reclosable bag 44 incorporating a slider 10 and a zipper 25 of the above-described types. The zipper 25 is disposed across the transverse top edges 42 and 43 of the front and rear walls of reclosable bag 44. In use, the straddling slider 10 is slidable along the zipper in a closing direction A to cause the interlocking members 22 and 26 to be fully engaged. When the slider 10 is moved in an opening direction B, the interlocking members are disengaged by pinching the arms 17 and 18 at the zipper opening end 12 of the slider 10.

Figure 5:
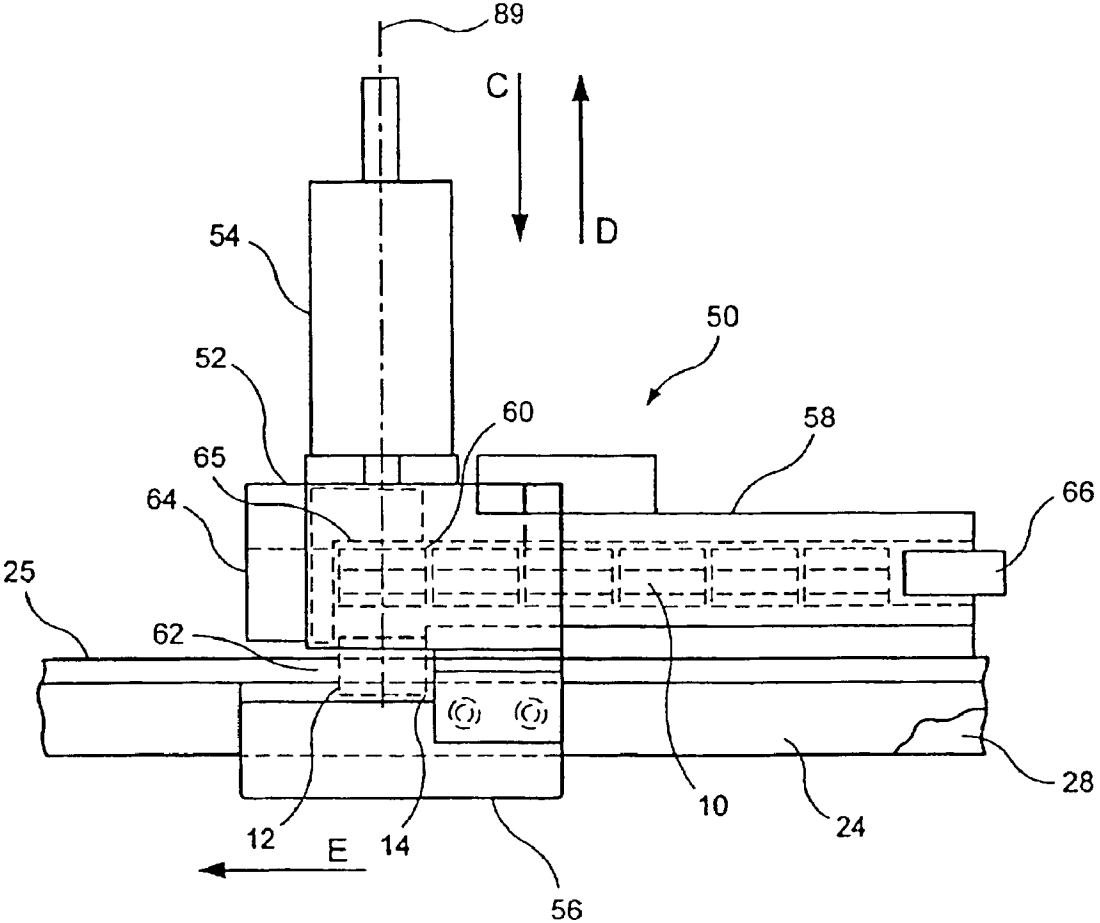
FIG. 5 is a drawing showing a side view of a slider insertion apparatus having a horizontal slider loading rack.

FIG. 5 is a top view depicting one type of slider insertion apparatus 50 in which sliders are intermittently and successively inserted on a horizontally disposed continuous zipper tape, which will be cut later to form successive zippers 25. Prior to feeding to the slider insertion apparatus, the zipper tape may be stomped at package intervals to form slider end stops (not shown).

The slider insertion apparatus comprises an activator with pusher 52, an insertion cylinder 54 and a zipper guide 56. A loading rack 58 is a magazine-type rack supplying individual sliders 10 at an entry point 60. The loading rack may be part of the slider insertion apparatus 50 or may be mechanically attached to the slider insertion apparatus. Although a linear rack is shown in FIG. 5, alternatively the loading rack may be curved.

Still referring to FIG. 5, the activator with pusher 52 comprises an activating fork 64. During an insertion in slider insertion area 62, the activating fork 64 is moved in direction C and during its descent, offsets the interlocking members 22 and 26 of a zipper 25 in an area adjacent the slider insertion area 62. This causes the offset portions to separate, i.e., open. In the specific embodiment shown in FIG. 5, a zipper guide 56 guides the zipper tape 25 toward the slider insertion area 62. Although FIG. 5 depicts a guide blade attached to the base of the slider insertion apparatus by means of an attachment piece to which the blade is fastened, the blade and attachment means can be formed as a unitary piece, as will be seen in later drawings.

Coinciding with the movement of the activating fork 64 in direction C, a pusher 65 of the activator with pusher 52 inserts the slider 10 on the zipper tape. As the slider is inserted, the inclined side surfaces of the A-shaped zipper shown in FIGS. 2 and 3 cause the slider side walls to flex outward. The slider returns to an unflexed state when the projections directed inward from the bottoms of the slider side walls latch under the bottoms of the zipper profiles. The activator with pusher 52 is driven in direction C with a force exerted by the insertion cylinder 54. The insertion cylinder 54 is preferably pneumatically driven. The activation fork 64 and pusher 65 can be driven, as shown, by a single cylinder or, in the alternative, by separate cylinders.

After insertion of the slider 10 onto the zipper 25, the activator with pusher 52 retracts in direction D. This retraction movement allows the loading rack 58 to pneumatically deliver another slider 10 to the slider insertion apparatus 50 at the entry point 60. The slider 10 may be delivered pneumatically or a mechanical pawl 66 may also be used on the loading rack 58 for moving the slider 10 to the slider insertion apparatus. The mechanical pawl 66 is typically used if the insertion rate requirements must be in excess of a few per minute.

The zipper guide 56 then guides a next length of zipper tape (corresponding to the next zipper) in direction E into the slider insertion apparatus 50. As each section of the zipper tape 25 enters and advances through the zipper guide 56, a pair of opposing grooves form a channel that matches the overall profile of the zipper to prevent the zipper from opening or rolling from side to side, contributing to a stable insertion of each slider 10.

FIG. 5 shows the case where activation occurs forward of the slider insertion area (the forward direction being indicated by arrow E in FIG. 5). However, the positions of the activating fork and pusher can be reversed so that activation occurs to the rear of the slider insertion area. In such cases, it is advantageous to use the retractable zipper guide disclosed herein.

Figure 6:
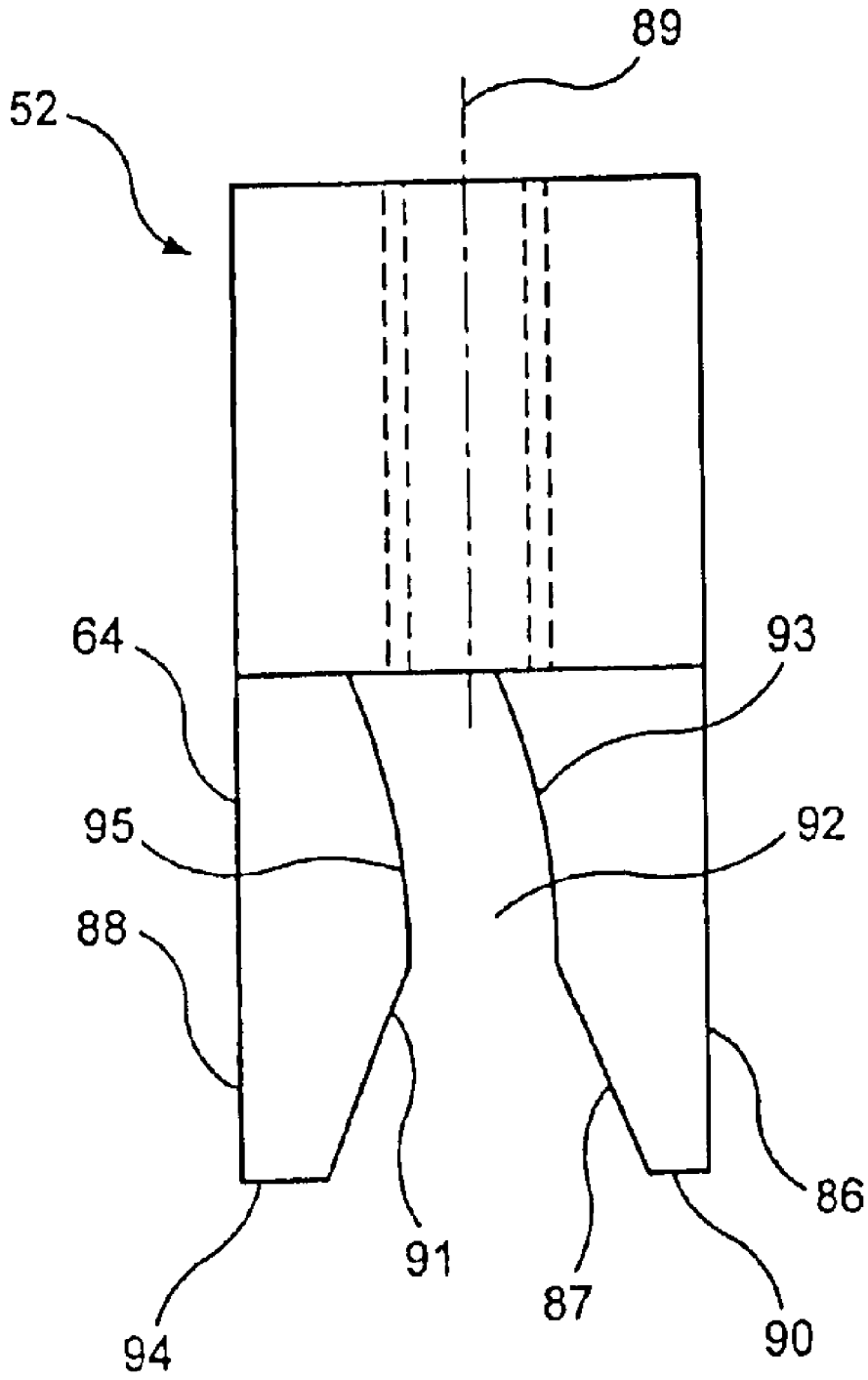
FIG. 6 is a drawing showing an end view of an activating fork that is used to activate a section of zipper adjacent where the slider is inserted.

In the offsetting or activating action, the interlocking members are partially disengaged but are not separated. When the interlocking members 22 and 26 are offset in relation to each other, the keeper 15 can properly secure the interlocking member 22, as seen in FIG. 2. The offsetting action is produced by an activating fork of the type shown in FIG. 6. The activating fork 64 comprises a pair of arms or fins 86 and 88. From respective lower ends 90, 94, the inner surfaces of the lower portions 87, 91 of the fins chamfer towards a central plane 89. These chamfers facilitate entry of the zipper profiles into the activating fork when the latter is pushed onto the zipper. The interior surface of upper portion 93 of fin 86 further tapers toward the plane 89 and the interior surface of upper portion 95 of the opposite fin 88 tapers parallel to the upper portion 93 of the fin 86, i.e., tapers away from the plane 89. During travel upward (as seen in FIG. 6) through the channel 92, the zipper profiles are deflected sideways by the contoured surface 93, so that the sections of zipper profiles in the channel 92, as well as the contiguous sections under the inserted slider and adjacent the keeper 15 (see FIG. 2), become offset. More specifically, the portion of the zipper part with female profile that underlies keeper 15 in the slider is offset, as seen in FIG. 2, and thus is secured within the slider by the keeper. Thus, the zipper section at the opening end of the slider is activated in the sense of being held open by the keeper.

FIG. 5 shows a slider insertion apparatus having a zipper guide that does not allow zipper tape with sliders inserted thereon to pass through the zipper guide. In contrast, the present invention envisions a zipper guide that allows zipper tape with sliders inserted thereon to pass over the guide without obstruction. This is accomplished by providing retractable grippers which alternately grip the zipper tape during slider insertion and then release the zipper tape with sufficient clearance to allow a slider inserted on the zipper tape to pass through and on to the next stage in production, e.g., to a sealing station where the zipper tape flanges will be heat sealed to opposing walls of a folded web of bag making film. One embodiment of the present invention will now be described with reference to FIGS. 7 and 8.

Figure 7:
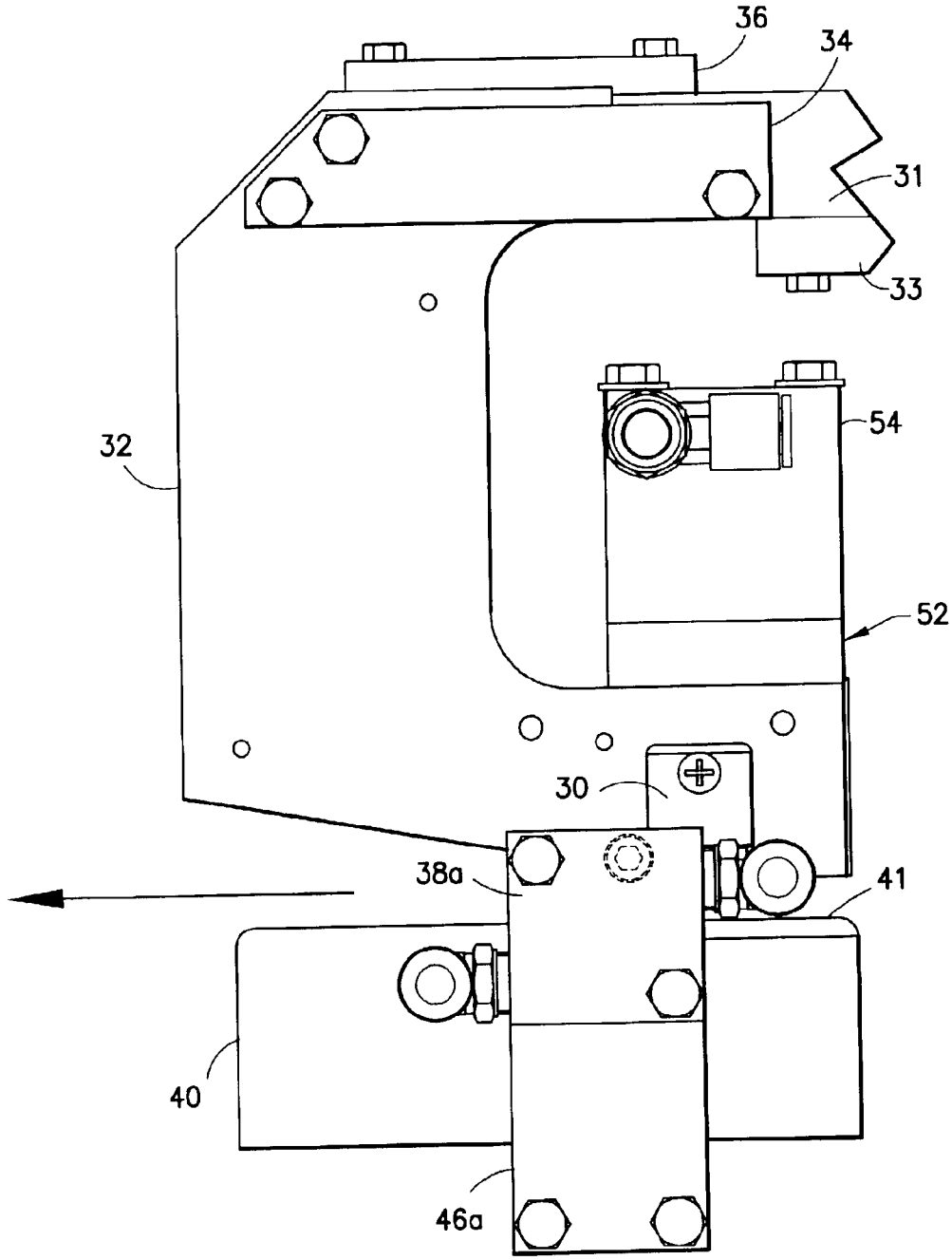
FIGS. 7 and 8 are drawings showing top and rear views of a slider insertion apparatus with a zipper guide and zipper gripper in accordance with one embodiment of the present invention.

FIG. 7 is a top view showing a slider insertion machine comprising a U-shaped slider base 32 that is connected to an air jet rail 31 (shown only in part) by means of a pair of splice plates (only one of which is depicted and designated 34, and a support plate 36. The numeral 33 designates an air jet rail cover, which is also shown only in part. Sliders are fed from a source, e.g., a vibratory hopper (not shown), to the slider insertion device via a flexible feeder tube (not shown), which is connected to the air jet rail 31 at a point not shown in FIG. 7. The feeder tube has a channel with a recess that receives the projection 11 (see FIGS. 2 and 3) that is formed on only one side of the slider. The clearance between the sliders and the feeder tube channel is such that the sliders may enter the feeder tube from the hopper only if the slider is correctly oriented, namely, with the slider opening end leading. However, in the particular exemplary application described below, the slider is inserted on the zipper tape with the closing end facing in the direction of zipper tape advancement. Therefore, the orientation of the sliders coming out of the feeder tube must be reversed relative to a fixed frame of reference, i.e., the sliders must be rotated 180°. The slider base 32 has a U-shaped channel that accomplishes this 180° reversal in slider orientation as the slider travels through the channel.

When the slider arrives at a slider insertion position under the activator with pusher, a spring inside the slider insertion machine captures the correctly oriented slider, holding it in place. During subsequent slider insertion, the pusher will push the slider toward the zipper tape with sufficient force to overcome the holding force being applied by the capture spring. Referring to FIG. 7, the location of the capture spring, indicated by reference numeral 30, is aligned with the pusher (not shown) of the activator with pusher 52. The activator with pusher is moved from a retracted position to an extended position by an air cylinder 54 for inserting a slider onto an underlying section of the zipper tape.

In addition to the slider being correctly positioned prior to insertion, the zipper tape must also be correctly positioned and supported in that correct position during slider insertion. As previously described, a zipper comprises interlockable zipper parts, each zipper part comprising a profiled closure element and an zipper flange connected to the closure element. The closure elements have complementary male and female profiles that enable the closure elements to be interlocked when engaged by the moving slider during use by the consumer. Each zipper is cutoff from a continuous zipper tape. Thus, the zipper tape has the same profile as that of the zipper in the completed reclosable package. For the purpose of illustrating the present invention, the zipper gripping and slider insertion operations will be described with reference to a zipper tape having the profile of the closed zipper depicted in FIG. 3.

Figure 8:
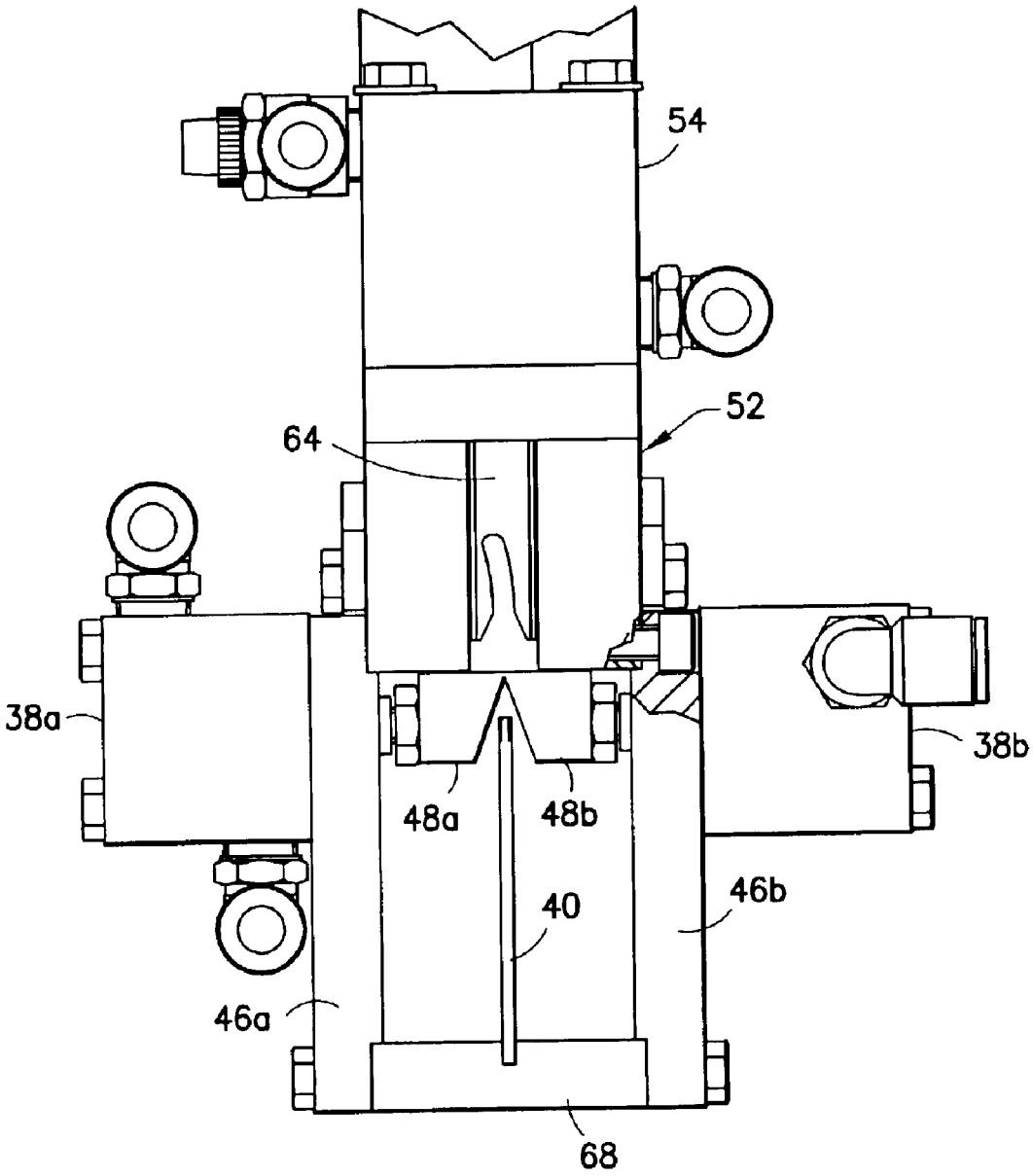

In one embodiment of an automated slider insertion apparatus depicted in FIGS. 7 and 8, the zipper tape is threaded over a saddle 40 comprising an elongated upright plate. As seen in FIG. 8, the bottom edge of the saddle 40 is welded in a groove formed in a guide weldment 68. The saddle 40 extends substantially perpendicular to guide weldment 68, which is fastened on opposing sides to respective hanger plates 46*a* and 46*b*. The hanger plates are in turn fastened to the slider base 32, extending in parallel to each other. The hanger plates 46*a* and 46*b*, in combination with the connecting guide weldment 68, provide a structure for supporting the saddle 40 in a fixed position below the slider base. As will be described below, the hanger plates also support respective air cylinders 38*a* and 38*b* for moving respective gripper fingers 48*a* and 48*b* that grip the zipper tape during slider insertion.

Figure 10:
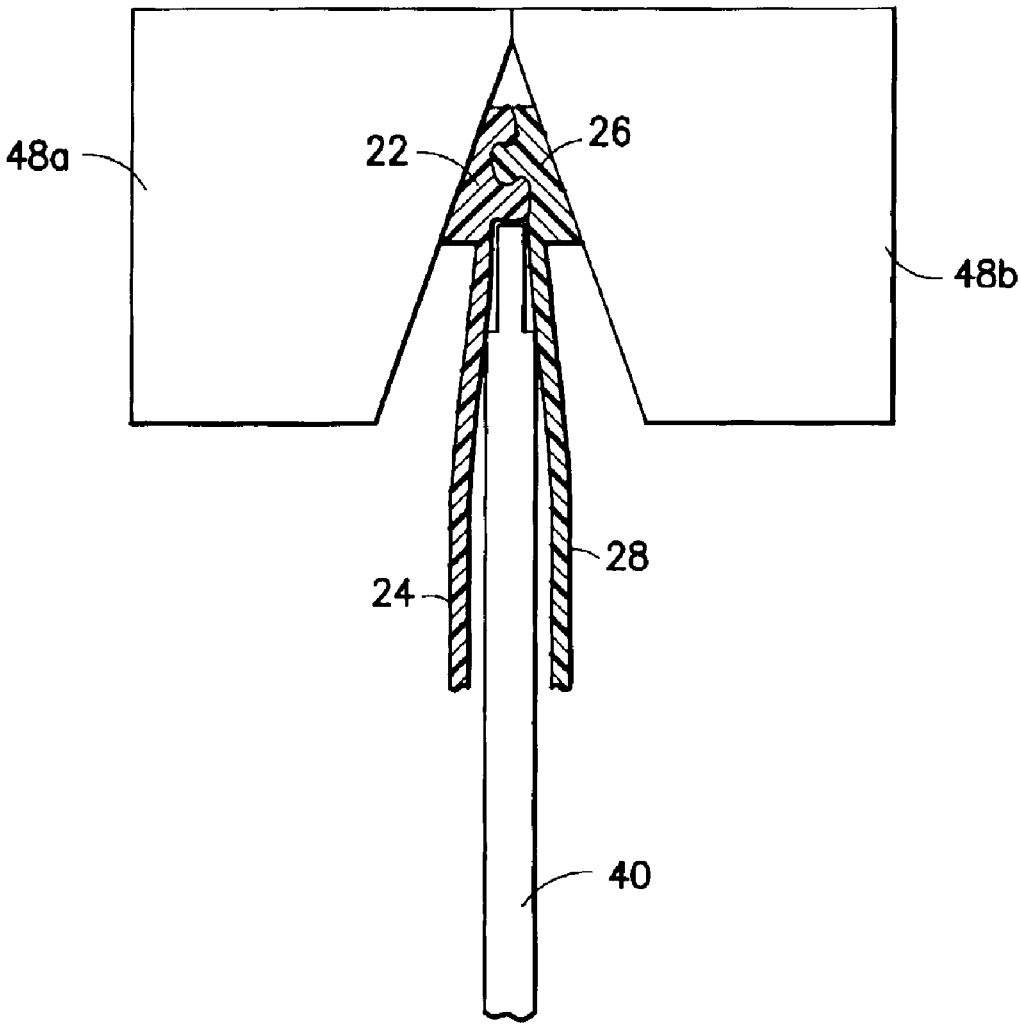
FIG. 10 is a drawing showing a rear view of the zipper gripper gripping a zipper tape shown in section.

As seen in FIG. 7, the saddle 40 has a straight contact edge 41. The zipper tape sits against contact edge 41 during slider insertion and slides along edge 41 during zipper tape advancement. The positional relationship of the saddle edge 41 and the zipper tape 25 is shown in FIG. 10. The saddle 40 is flanked by the zipper flanges 24 and 28 of the interlocked zipper halves, while the underbelly of an opposing section of the zipper tape sits against the contact edge 41 of the saddle 40.

To ensure that the zipper tape is correctly positioned prior to slider insertion, a pair of gripper fingers 48*a* and 48*b*, disposed on opposite sides of the zipper tape 25, grip a section of the zipper tape that is adjacent to the section of zipper tape on which the slider will be inserted. Each gripper finger is movable between respective extended and retracted positions by operation of air cylinders 38*a* and 38*b*. The gripper fingers are alternately extended and retracted. The gripper fingers 48*a* and 48*b* grip the zipper tape 25 when the gripper fingers are in their extended positions (as seen in FIG. 10); the gripper fingers do not grip the zipper tape when the gripper fingers are not in their extended positions. The extended gripper fingers form a V-shaped space therebetween that is intersected by the contact edge 41 of the saddle 40. When the gripper fingers are in their fully retracted positions, there is sufficient clearance between the gripper fingers and the saddle for the zipper tape with an inserted slider thereon to pass through, which is not the case when the gripper fingers are extended.

In the disclosed embodiment, each gripper finger comprises a respective angled block. However, the concept of the invention is broad enough to encompass grippers having other geometries. For the disclosed embodiment, the inclined surface of each angled block, which surface contacts the zipper, may optionally be textured or serrated to facilitate gripping of the inclined surfaces of the A-shaped zipper tape. However, pressure applied by smooth surfaces is also deemed to be "gripping". In the extended positions shown in FIG. 10, the gripper fingers 48*a* and 48*b* push the closure members of the zipper halves together and against the top of the saddle 40, thereby securely holding a first section of zipper tape in a fixed and proper position for receiving a slider. The activator with pusher 52 is then activated to perform the zipper activation and slider insertion functions previously described with reference to FIGS. 5 and 6. In particular, the activator with pusher is moved from a retracted position to an extended position by activation of the air cylinder 54. During the extension stroke, the activating fork 64 (seen in FIG. 8) engages a second section of the zipper tape, while the pusher (not visible in FIG. 8) pushes a slider onto a third section of the zipper tape. The gripper fingers, pusher and activating fork are arranged so that the inserted slider lies between the extended gripper fingers and the extended activating fork. Thus, on the leading side of the slider insertion area the zipper tape is held closed by the gripper, while on the lagging side of the slider insertion area the zipper tape is opened by the activating fork, which has the effect of opening an adjacent portion of the zipper tape in the slider insertion area, where keeper 15 (see FIG. 2) of the slider will engage the female zipper profile.

Figure 9:
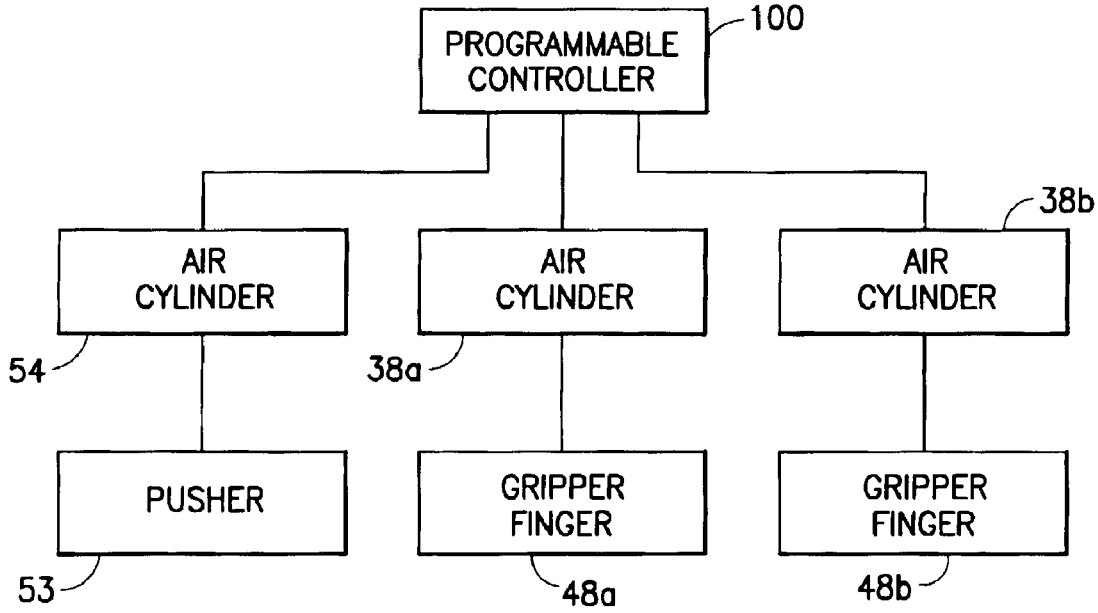
FIG. 9 is a block diagram generally representing programmable control of the zipper gripper and the slider inserter in the embodiment shown in FIGS. 7 and 8.

As previously mentioned, the extension and retraction of the gripper fingers 48*a* and 48*b* and the pusher 53 are achieved in the disclosed embodiment by means of respective air cylinders 38*a*, 38*b* and 54, generally represented in FIG. 9. Alternatively, hydraulic cylinders could be used. Operation of the cylinders is controlled by a programmable controller 100, which selectively activates the supply of fluid to the cylinders in accordance with an algorithm or logical sequence. The controller may also take the form of a computer or a processor having associated memory that stores a computer program for operating the slider insertion apparatus. The controller 100 is programmed to control cylinders 38*a*, 38*b* and 54 so that the slider is inserted by pusher 53 only while the gripper fingers 48*a* and 48*b* are in their respective extended positions. The controller 100 is further programmed to control cylinders 38*a* and 38*b* so that the gripper fingers move from their respective retracted positions to their respective extended positions concurrently and vice versa.

A person skilled in the art of machinery design will readily appreciate that displacing means other than cylinders can be used to displace the gripper elements and the slider inserter. Any other known mechanical displacement means can be used. For the sake of illustration, such mechanical displacement devices include rack and pinion arrangements, rotation of the pinion being driven by an electric motor. Also, although the slider insertion apparatus has been depicted in the drawings in a horizontal orientation, it will be appreciated by persons skilled in the art that the slider insertion apparatus disclosed herein operates equally well in a vertical plane for applications wherein the zipper tape is oriented in a vertical plane.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. An apparatus for inserting a slider onto a zipper tape comprising:

a pusher movable from a retracted position to an extended position for inserting the slider onto a first section of the zipper tape;

a saddle having a straight edge that is positioned to contact said first section of said zipper tape during insertion of a slider thereon; and first and second grippers disposed on opposite sides of a second section of said zipper tape, each of said first and second grippers being movable between respective extended and retracted positions to grip said zipper tape when said grippers are in said extended positions and to not grip said zipper tape when said grippers are not in said extended positions, wherein said zipper tape comprises first and second profiled interlockable closure members and first and second extension flanges respectively connected to said first and second closure members and extending generally in the same direction, said saddle being disposed between said first and second zipper flanges.

2. The apparatus as recited in claim 1, wherein when said first and second grippers are in said extended positions, there is insufficient clearance between said first and second grippers and said saddle for said zipper tape with an inserted slider thereon to pass through, whereas when said first and second grippers are in said retracted positions, there is sufficient clearance between said first and second grippers and said saddle for said zipper tape with an inserted slider thereon to pass through.

3. The apparatus as recited in claim 1, further comprising a first cylinder for moving said first gripper, a second cylinder for moving said second gripper, and a third cylinder for moving said pusher.

4. The apparatus as recited in claim 3, wherein said cylinders are pneumatic cylinders.

5. The apparatus as recited in claim 3, further comprising a controller programmed to control said first, second and third cylinders so that said slider is inserted only while said grippers are in their respective extended positions.

6. The apparatus as recited in claim 3, further comprising a controller programmed to control said first and second cylinders so that said first and second grippers move from said respective retracted positions to said respective extended positions concurrently.

7. The apparatus as recited in claim 1, wherein said first and second zipper flanges are joined to a bag making film.

8. The apparatus as recited in claim 1, wherein said first and second grippers in said extended positions push said first and second closure members together and against said saddle.

9. The apparatus as recited in claim 1, wherein each of said grippers comprises a respective angled block.

10. The apparatus as recited in claim 1, wherein said first and second grippers in said extended positions form a V-shaped space therebetween that is intersected by said straight edge of said saddle.

11. An apparatus for holding a zipper tape of the type comprising first and second profiled interlockable closure members and first and second extension flanges respectively connected to said first and second closure element and extending generally in the same direction, said first and second interlockable closure members being interlocked, comprising:

a saddle having a straight edge that is inserted between said first and second zipper flanges for supporting a section of said zipper tape; and first and second grippers disposed on opposite sides of said zipper tape, each of said first and second grippers being movable between respective extended and retracted positions to press said first and second closure members together when said grippers are in said extended positions and to not press said first and second closure members together when said grippers are not in said extended positions, wherein each of said first and second grippers comprises a respective angled block.

12. The apparatus as recited in claim 11, wherein when said first and second grippers are in said extended positions, there is insufficient clearance between said first and second grippers and said saddle for said zipper tape with an inserted slider thereon to pass through, whereas when said first and second grippers are in said retracted positions, there is sufficient clearance between said first and second grippers and said saddle for said zipper tape with an inserted slider thereon to pass through.

13. The apparatus as recited in claim 11, further comprising a first cylinder for moving said first gripper, a second cylinder for moving said second gripper, and a controller programmed to control said first and second cylinders so that said first and second grippers move from said respective retracted positions to said respective extended positions concurrently.

14. The apparatus as recited in claim 11, wherein said first and second grippers in said extended positions form a V-shaped space therebetween that is intersected by said straight edge of said saddle.

15. A slider insertion machine comprising:

an assembly for inserting sliders onto a first section of a zipper tape;

first and second grippers disposed on opposite sides of a second section of said zipper tape, each of said first and second grippers being movable between respective extended and retracted positions to grip said second section when said grippers are in said extended positions and to not grip said second section when said grippers are not in said extended positions; and a saddle having a straight edge that is positioned to contact said first and second sections of said zipper tape during insertion of a slider thereon, wherein said zipper tape comprises first and second profiled interlockable closure members and first and second extension flanges respectively connected to said first and second closure members and extending generally in the same direction, said saddle being disposed between said first and second zipper flanges.

16. The machine as recited in claim 15, wherein said saddle comprises a plate.

17. The machine as recited in claim 15, wherein each of said first and second grippers comprises a respective angled block.

18. The machine as recited in claim 15, wherein said first and second grippers in said extended positions form a V-shaped space that is intersected by said straight edge of said saddle.

19. The machine as recited in claim 15, wherein when said first and second grippers are in said extended positions, there is insufficient clearance between said first and second grippers and said saddle for said zipper tape with an inserted slider thereon to pass through, whereas when said first and second grippers are in said retracted positions, there is sufficient clearance between said first and second grippers and said saddle for said zipper tape with an inserted slider thereon to pass through.

20. A method of inserting a slider onto a zipper tape, comprising the following steps:

seating a zipper tape on a saddle with said saddle disposed between first and second zipper flanges of said zipper tape;

advancing said zipper tape to a longitudinal position whereat a first section of said zipper tape is in a slider insertion zone;

extending a pair of grippers to press against a second section of said zipper tape from opposite sides; and inserting a slider onto said first section of said zipper tape while said second section of said zipper tape is being gripped.

21. The method as recited in claim 20, further comprising the steps of retracting said grippers and advancing said zipper tape with said inserted slider thereon past the position of said grippers.

22. A method of inserting sliders onto a zipper tape, comprising the following steps:

seating a zipper tape on first and second saddles with zipper flanges of said zipper tape flanking said saddles, said first and second saddles being in line and spaced apart;

advancing said zipper tape to a longitudinal position whereat a first section of said zipper tape is in a first slider insertion zone overlying a portion of said first saddle and a second section of said zipper tape is in a second slider insertion zone overlying a portion of said second saddle;

concurrently extending a first pair of grippers to press against a third section of said zipper tape from opposite sides and a second pair of grippers to press against a fourth section of said zipper tape from opposite sides; and concurrently inserting a first slider onto said first section and a second slider onto said second section of said zipper tape while said third and fourth sections of said zipper tape are being gripped.

23. The method as recited in claim 22, further comprising steps of concurrently retracting said first and second pairs of grippers and advancing said zipper tape with said first and second sliders thereon by a distance such that at least one of said first and second sliders passes at least one of said first and second pairs of grippers before said grippers of said first and second pairs are returned to said extended positions.

24. An apparatus comprising:

a rigid base;

a pusher;

first means for displacing said pusher along a first axis, said first displacing means being mounted to said base;

a support structure supported by said base;

a plate attached to said support structure and extending from said support structure toward said pusher, said plate lying in a plane generally parallel with said first axis;

first and second gripper elements;

second means for displacing said first gripper element along a second axis generally transverse to said first axis, said second displacing means being mounted to said support structure; and third means for displacing said second gripper element along a third axis generally transverse to said first axis, said third displacing means being mounted to said support structure.

25. The apparatus as recited in claim 24, wherein said displacing means are cylinders.

26. The apparatus as recited in claim 24, wherein said support structure comprising first and second hanger plates that are generally mutually parallel and a crosspiece supported by said first and second hanger plates, wherein said plate is attached to said cross piece and said second and third displacing means are respectively attached to said first and second hanger plates.

27. The apparatus as recited in claim 24, further comprising a programmable controller that coordinates the activation of said first, second and third displacing means.

* * * * *